US008998626B2

(12) United States Patent
Kitajima et al.

(10) Patent No.: US 8,998,626 B2
(45) Date of Patent: Apr. 7, 2015

(54) CONNECTOR AND CONNECTOR ASSEMBLY

(75) Inventors: Mitsunori Kitajima, Yokkaichi (JP); Youjirou Hashimoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 249 days.

(21) Appl. No.: 13/488,670

(22) Filed: Jun. 5, 2012

(65) Prior Publication Data

US 2012/0329299 A1 Dec. 27, 2012

(30) Foreign Application Priority Data

Jun. 27, 2011 (JP) ..... 2011-142280

(51) Int. Cl.

| | |
|---|---|
| ***H01R 13/62*** | (2006.01) |
| ***H01R 13/44*** | (2006.01) |
| ***H01R 13/436*** | (2006.01) |
| ***H01R 12/71*** | (2011.01) |
| ***H01R 13/64*** | (2006.01) |
| *H01R 13/506* | (2006.01) |
| *H01R 13/629* | (2006.01) |

(52) U.S. Cl.

CPC ..... *H01R 13/4362* (2013.01); *H01R 12/716* (2013.01); *H01R 13/506* (2013.01); *H01R 13/62905* (2013.01); *H01R 13/62933* (2013.01); *H01R 13/64* (2013.01)

(58) Field of Classification Search

CPC ..... H01R 13/6295; H01R 13/62955; H01R 13/62933

USPC ..... 439/157–160, 147, 489, 352

See application file for complete search history.

(56) References Cited

U.S. PATENT DOCUMENTS

| | | | | |
|---|---|---|---|---|
| 5,609,494 | A * | 3/1997 | Yamaguchi et al. | 439/157 |
| 6,413,105 | B2 * | 7/2002 | Noro et al. | 439/157 |
| 7,137,835 | B2 * | 11/2006 | Shiga | 439/157 |
| 7,261,575 | B2 * | 8/2007 | Buchter et al. | 439/157 |
| 2004/0132332 | A1 | 7/2004 | Koehler | |
| 2005/0215122 | A1 | 9/2005 | Nishida | |
| 2006/0240693 | A1 * | 10/2006 | Nishide | 439/157 |

FOREIGN PATENT DOCUMENTS

| | | |
|---|---|---|
| JP | 2009-181717 | 8/2009 |

* cited by examiner

*Primary Examiner* — Briggitte R Hammond

(74) *Attorney, Agent, or Firm* — Gerald E. Hespos; Michael J. Porco; Matthew T. Hespos

(57) ABSTRACT

A female connector (F) is formed such that a block-shaped terminal accommodating portion (21) accommodating female terminal fittings (24) is surrounded by a substantially rectangular tubular fitting (35). A male connector (M) includes a rectangular tubular receptacle (11) to be fit into a clearance between the terminal accommodating portion (21) and the tubular fitting (35) and tabs (13) at the leading ends of male terminal fittings (12) are surrounded by the receptacle (11). Bulges (51, 52 and 53) are formed on four wall portions (37, 38 and 39) of the tubular fitting 35 and bulge outward of the tubular fitting (35) from an opening edge part at a front side of the tubular fitting (35).

10 Claims, 6 Drawing Sheets

CONNECTOR AND CONNECTOR ASSEMBLY

BACKGROUND OF THE INVENTION

1. Field of the Invention

The invention relates to a connector and to a corresponding connector assembly.

2. Description of the Related Art

Japanese Unexamined Patent Publication No. 2009-181717 discloses a connector assembly with male and female connectors. The female connector has a block-shaped terminal accommodating portion surrounded by a substantially rectangular tubular fitting. Female terminal fittings are accommodated in the terminal accommodating portion. The male connector has a rectangular tubular receptacle that can fit into a clearance between the terminal accommodating portion and the tubular fitting. Male terminal fittings are mounted in the male connector and have tabs that project into the receptacle. A connection rib projects from the back end surface of the receptacle to prevent the female connector from interfering with the tabs if the female connector is inserted into the receptacle in an improper oblique posture. More particularly, the connection rib will contact the obliquely aligned female connector and hinder further insertion before the obliquely aligned female connector can contact the tabs.

The connection rib that projects from the back end surface of the receptacle complicates the shape of the male connector. Additionally, the terminal accommodating portion must be formed with a recess for receiving the connection rib, and hence the female connector also has a complicated shape.

The present invention was completed in view of the above situation and an object thereof is to simplify shape.

SUMMARY OF THE INVENTION

The invention relates to a connector that is connectable with a mating connector. The connector comprises a housing with a terminal accommodating portion for accommodating at least one terminal fitting. A tubular fitting surrounds the terminal accommodating portion. The mating connector includes a receptacle that can be fit into a clearance between the terminal accommodating portion and the tubular fitting. At least one bulge bulges out from a front opening edge of a wall of the tubular fitting. The bulge is engageable with the receptacle of the mating housing to avoid connection of the connector with the mating connector in an improper posture.

An attempt could be made to insert the connector into the receptacle in an improper (e.g. oblique) posture. However, the bulge of the tubular fitting will contact an opening edge of the receptacle to prevent the connector from being inserted deeply into the receptacle and contacting mating terminal fittings. The opening edge of the tubular fitting merely bulges out for preventing contact of the connector with the mating terminal fittings. Accordingly, the shape of the connector is relatively simple and it is not necessary to change the shape of the mating connector.

A bulge may be formed on each wall of the tubular fitting.

A mounting hole may be open on the outer surface of the terminal accommodating portion and may receive a retainer for retaining the terminal fitting.

An operation hole may be formed in the tubular fitting behind the bulge and defines a through hole corresponding to the mounting hole.

A finger placing surface may be formed on an area of the outer surface of the tubular fitting behind and adjacent to the operation hole. The finger placing surface which will face one or more fingers operating the retainer facing the operation hole.

The finger placing surface may be recessed in the outer surface of the tubular fitting. A formation range in the width direction of the bulge is substantially the same as the formation range of the operation hole and/or the finger placing surface.

An operation space is defined between the outer surface of the terminal accommodating portion that has the mounting hole and the inner surface of the wall of the terminal fitting corresponding to the mounting hole. A jig can be inserted into the mounting space from the front for moving the retainer away from the mounting hole.

The bulge preferably is formed on the wall facing the operation space and the inner surface of the bulge facing the operation space preferably is recessed. Thus, the operation space becomes larger and operability of the jig is improved. Further, since the bulge formed with the cutout bulges outwardly of the tubular fitting, the wall is not thinned excessively even if the cutout is formed by recessing the inner surface The connector may further comprise a movable member that may be displaced on the tubular fitting between an initial position and a connection position for connecting and/or separating the connector with the mating connector. The movable member may be held at the connection position by a lock that projects from an outer surface of the bulge.

The invention also relates to a connector assembly comprising the above-described connector and the above-described mating connector.

These and other objects, features and advantages of the present invention will become more apparent upon reading of the following detailed description of preferred embodiments and accompanying drawings.

DETAILED DESCRIPTION OF THE PREFERRED EMBODIMENTS

Figure 5:
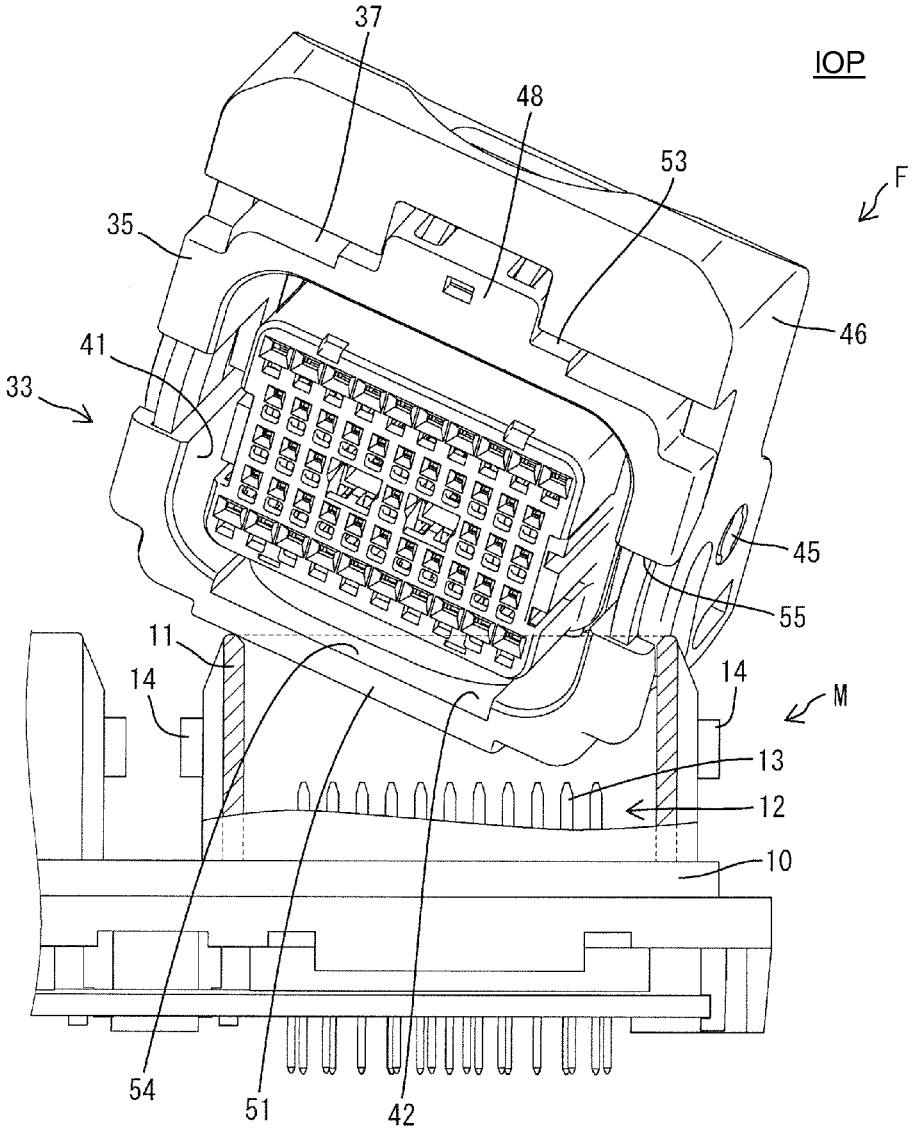
FIG. 5 is a side view partly in section showing a state where the female connector is inserted in an improper oblique posture into a receptacle.

A connector in accordance with an embodiment of the invention includes a male connector M and a female connector F. As shown in FIG. 5, the male connector M includes a substantially plate-like or flat terminal holding portion 10 made e.g. of synthetic resin and rectangular tubular receptacles 11 made e.g. of synthetic resin project forward (up in FIG. 5) from the terminal holding portion 10. Male terminal fittings 12 are held in the terminal holding portion 10, and tabs 13 at the leading ends of the respective male terminal fittings 12 project out and up. Specifically, the leading ends of the tabs 13 are at positions more back (down in FIG. 5) from the opening end of the receptacle 11. Two cam followers 14 are formed on the outer surface of each receptacle 11.

Figure 3:
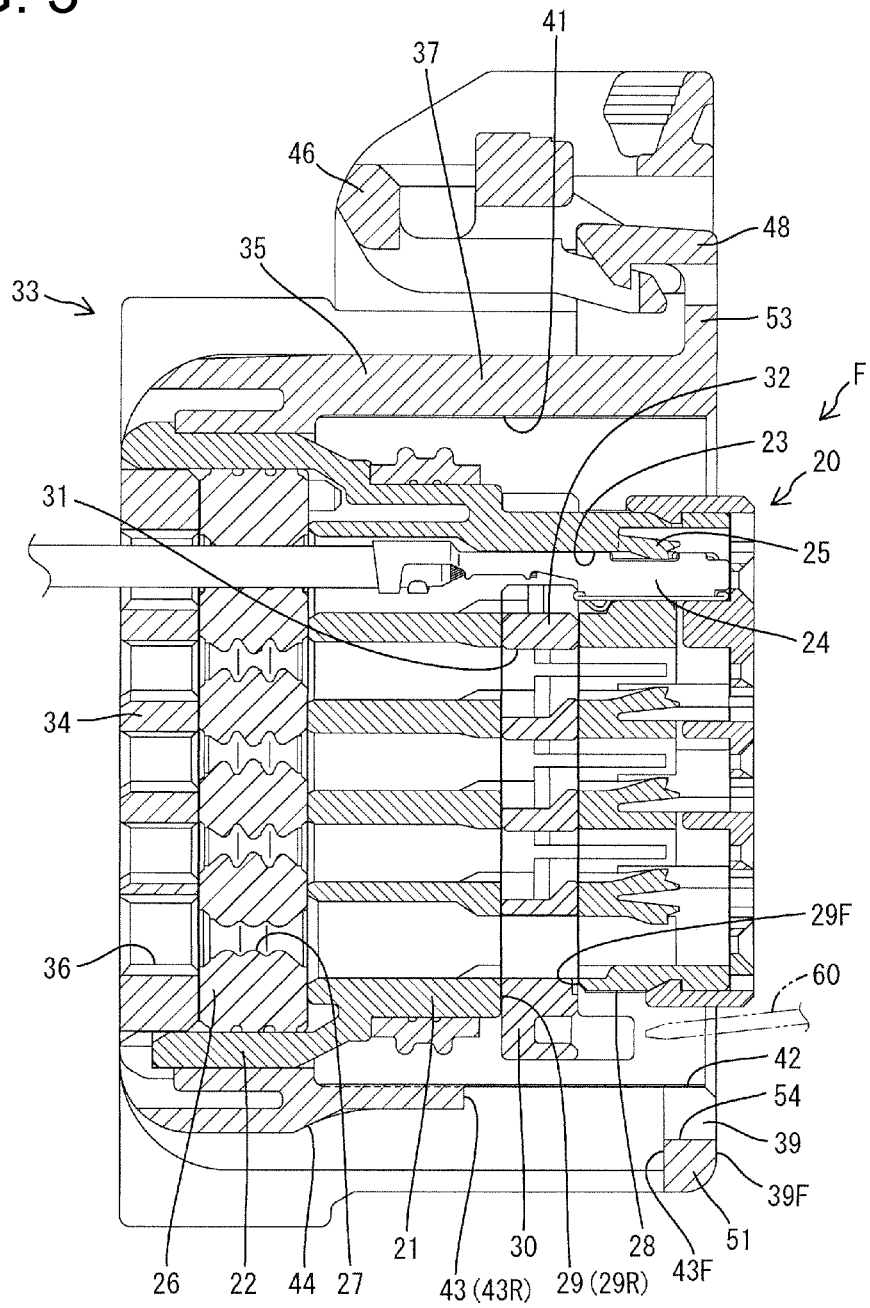
FIG. 3 is a section of the female connector.

As shown in FIG. 3, the female connector F comprises an inner housing 20, a one-piece resilient or rubber plug 26, a retainer 30 and an outer housing 33. The inner housing 20 is an integral assembly of a substantially block-shaped terminal accommodating portion 21 made e.g. of synthetic resin and a rectangular tubular accommodating portion 22 projecting back from the outer periphery of a rear end (left end in FIG. 3) of the terminal accommodating portion 21. Cavities 23 are formed in the terminal accommodating portion 21, and female terminal fittings 24 are to be inserted into the cavities 23 from behind and are retained by locking lances 25. The one-piece resilient plug 26 is accommodated in the tubular accommodating portion 22 so that seal holes 27 through the one-piece resilient plug 26 correspond to the cavities 23.

A mounting hole 29 is open on a lower surface 28 of the terminal accommodating portion 21 and communicates with the cavities 23. The retainer 30 is mounted in the mounting hole 29 for collectively retaining the female terminal fittings 24 in the cavities 23.

The retainer 30 is movable in a direction substantially perpendicular to the lower surface 28 of the terminal accommodating portion 21 between a partial locking position, shown in FIG. 3, and a full locking position (not shown) where the retainer 30 is accommodated more deeply in the mounting hole 29 than at the partial locking position. The retainer 30 includes through holes 31 and retaining portions 32 substantially corresponding to the cavities 23. The through holes 31 align with the cavities 23 when the retainer 30 is at the partial locking position to permit insertion and withdrawal of the female terminal fittings 24 into and from the cavities 23. The retaining portions 32 enter the cavities to engage and retain the female terminal fittings 24 when the retainer 30 is moved to the full locking position. A lower end of the retainer 30 projects out from the lower surface 28 of the terminal accommodating portion 21 when the retainer 30 is at the partial locking position.

Figure 1:
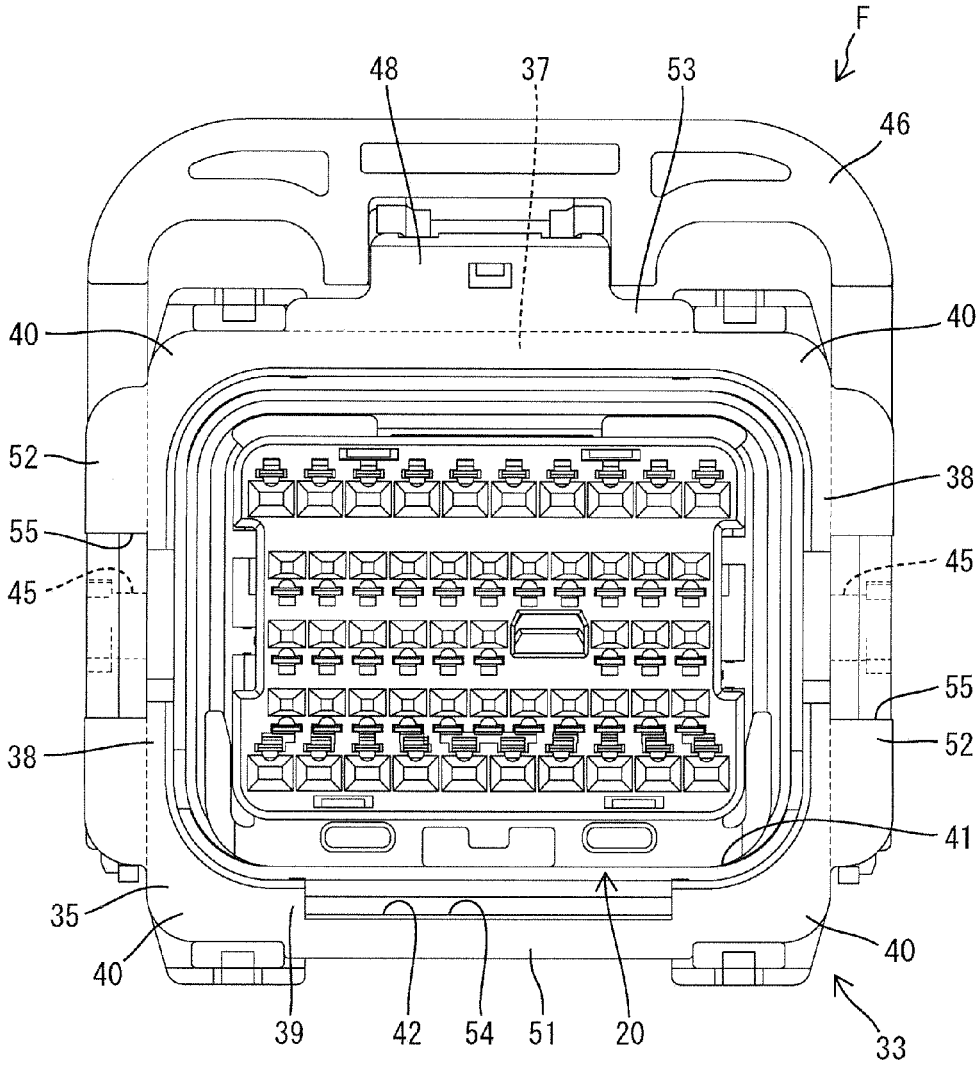
FIG. 1 is a front view of a female connector according to one embodiment.

As shown in FIGS. 1 and 3, the outer housing 33 is made unitarily of synthetic resin and includes a rear wall 34 facing the rear surface of the one-piece resilient plug 26 and a rectangular tubular fitting 35 projecting forward from the outer periphery of the rear wall 34. Insertion holes 36 extend through the rear wall 34 at positions corresponding to the seal holes 27 and the cavities 23. The tubular fitting 35 is bilaterally symmetrical and has an upper wall 37, left and right side walls 38, a lower wall 39 and corners 40 connecting the adjacent walls 37 and 38, 38 and 39.

The outer and inner housings 33 and 20 are assembled so that the rear wall 34 contacts the rear surface of the one-piece resilient plug 26 and the tubular fitting 35 surrounds the terminal accommodating portion 21. Additionally, the insertion holes 36 of the rear wall 34 correspond to the respective seal holes 27 when the housings 20, 33 are assembled. The female terminal fittings 24 are inserted into the cavities 23 by successively passing the respective insertion holes 36 and the seal holes 27. Further, a space between the outer peripheral surface of the terminal accommodating portion 21 and the inner peripheral surface of the tubular fitting 35 is open at the front and defines a connection space 41 for receiving the receptacle 11.

An operation space 42 is defined in a portion of the connection space 41 between the lower surface 28 of the terminal accommodating portion 21 and the lower wall 39 facing the mounting hole 29. The operation space 42 is a work space for receiving a jig 60 from the front (right side in FIG. 3) to move the retainer 30 away from the mounting hole 29 (i.e. a direction from the full locking position toward the partial locking position).

Figure 4:
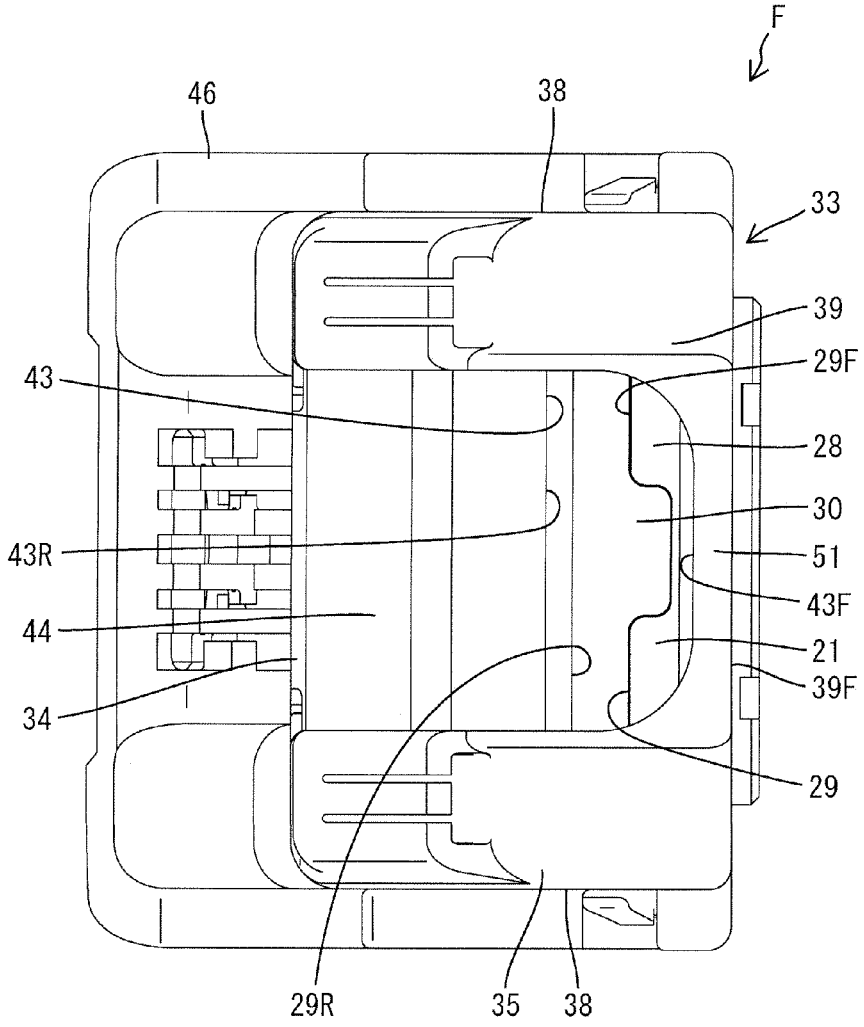
FIG. 4 is a bottom view of the female connector.

As shown in FIGS. 3 and 4, a bilaterally symmetrical operation hole 43 penetrates through an area of the lower wall 39 substantially corresponding to the mounting hole 29. The operation hole 43 enables the retainer 30 to be pushed manually from the outer side of the tubular fitting 35 from the partial locking position to the full locking position. A formation area of the operation hole 43 in a width direction is a continuous area of the lower wall 39 except both left and right end parts (i.e. range slightly narrower than the entire width) and does not extend to the rounded corners 40 connected to the left and right ends of the lower wall 39. A formation range of the operation hole 43 in forward and backward directions includes an opening area of the mounting hole 29. A front end edge 43F of the operation hole 43 is slightly before a front end edge 29F of the mounting hole 29 and behind a front end edge 39F of the lower wall 39. A rear end edge 43R of the operation hole 43 is slightly behind a rear end edge 29R of the mounting hole 29. Further, both left and right end parts of the front end edge 43F of the operation hole 43 are curved in a quarter-circular manner.

A finger placing surface 44 is defined in an area of the outer surface of the lower wall 39 that will face fingers when the part of the retainer 30 facing the operation hole 43 is pushed manually. A formation range of the finger placing surface 44 in forward and backward directions extends from the rear edge 43R of the operation hole 43 to the rear end of the lower wall 39 of the tubular fitting 35. A formation range of the finger placing surface 44 in the width direction is substantially the same area as the opening range of the operation hole 43. This finger placing surface 44 is recessed relative to an area of the lower wall 39 where the finger placing surface 44 and the operation hole 43 are not formed. Accordingly, an elevation difference between the finger placing surface 44 and the lower surface 28 of the terminal accommodating portion 21 is smaller than an elevation difference between an area of the lower wall 39 where the finger placing surface 44 is not formed and the lower surface 28 of the tubular accommodating portion 22. Further, an area of the finger placing surface 44 at a front end close to the operation hole 43 is slightly lower than an area thereof at a rear end distant from the operation hole 43.

Figure 2:
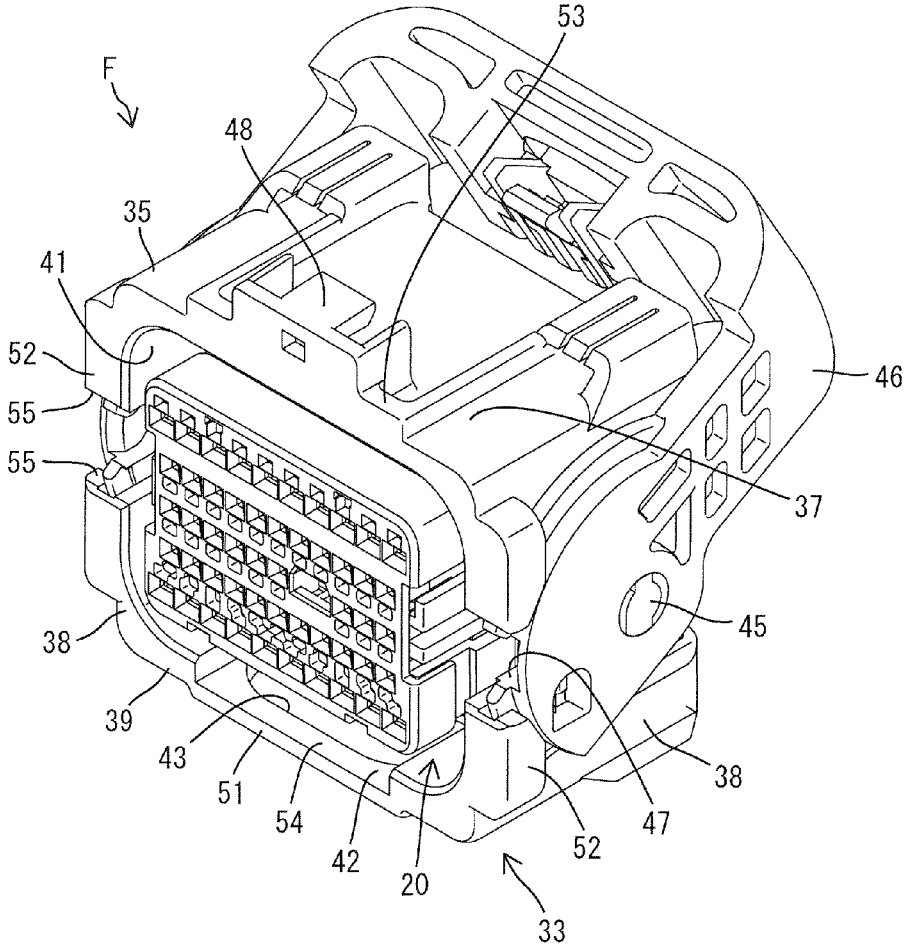
FIG. 2 is a perspective view of the female connector.

Supporting shafts 45 project from the left and right side walls 38 of the tubular fitting 35, and a lever 46 is mounted on the supporting shafts 46 for rotation between an initial position shown in FIGS. 2 and 4 and a connection position shown in FIGS. 1, 3 and 5. The female connector F is fit lightly to the male connector M with the lever 46 at the initial position so that the cam followers 14 engage with cam grooves 47 (see FIG. 2) of the lever 46. The lever 46 then is rotated to the connection position for connecting the female connector F and the male connector M. A lock 48 projects from an opening edge of the outer surface of the upper wall portion 37 of the tubular fitting 35. The lever 46 that has been rotated to the connection position engages the lock 48 and is held at the connection position to lock the female connector F and the male connector M in a connected state.

As shown in FIG. 1, the tubular fitting portion 35 is formed with first to third bulges 51, 52 and 53 bulging outwardly of the tubular fitting 35 from an opening edge part at a front side of the tubular fitting 35. The bulges are formed on all four walls 37, 38 and 39 of the tubular fitting 35 and function as means for preventing the contact of the female connector F with the tabs 13 when the female connector F is inserted in an improper oblique posture IOP into the receptacle 11 as shown in FIG. 5.

The first bulge 51 is formed substantially bilaterally symmetrically on the lower wall 39 of the tubular fitting 35, as shown in FIGS. 1 and 4. The first bulge 51 extends continuously across the width of the lower wall 39 except the left and right end parts. Accordingly, the first bulge 51 is not at the rounded corners 40 at the left and right ends of the lower wall 39. The formation range of the first bulge 51 in the width direction is substantially the same as the formation ranges of the operation hole 43 and the finger placing surface 44. Further, a formation range of the first bulge 51 in forward and backward directions is from the front end of the tubular fitting 35 to the front edge 43F of the opening edge of the operation hole 43.

As shown in FIG. 1, the outer surface of the first bulge 51 bulges out and down relative to an area of the lower wall 39 where the first bulge 51 is not formed while forming a step. Further, the outer surface of the first bulge 51 is parallel to the lower wall 39 and the upper wall 37. The lower wall 39 is formed with a cutout 54 by recessing the inner surface (surface facing the operation space 42) of the first bulge 51. A formation range of the cutout 54 in forward and backward directions is the same as the formation range of the first bulge 51. Further, the cutout 54 extends laterally over substantially the entire width of the first bulge 51. The inner surface of the first bulge 51 in an area where the cutout 54 is formed is parallel to the outer surface of the first bulge 51. Further, the thickness of the first bulge 51 in the area where the cutout 54 is formed is smaller than the thickness of the lower wall 39 in the area where the first bulge 51 is not formed.

As shown in FIG. 1, two substantially bilaterally symmetric second bulges 52 are formed along the left and right side walls 38. A formation range of the second bulge 52 in the vertical direction is an area extending from a position slightly above the upper ends of the side walls 38 and a position slightly below the lower ends of the side walls 38. The upper and lower ends of the second bulges 52 correspond to parts of the rounded corners 40 at the upper and lower ends of the side walls 38. A substantially central part of the second bulge 52 in the vertical direction is cut off to form an escaping portion 55. The escaping portion 55 defines an entrance path when the cam follower 14 is engaged with the cam groove 47 in connecting the connectors F, M. Further, the outer side surface of the second bulge 52 is positioned to be substantially flush with the outer side surface of the lever 46.

As shown in FIG. 1, the third bulge 53 is formed substantially bilaterally symmetrically along the upper wall 37 of the tubular fitting 35. A formation range of the third bulge 53 in the width direction is a continuous area of the upper wall 37 except both left and right end parts (i.e. range slightly narrower than the entire width). Accordingly, the third bulge 53 does not correspond to the rounded corners 40 connected to the left and right ends of the upper wall 37. The lock 48 for holding the lever 46 at the connection position particularly projects from the outer surface of the third bulge 53.

Figure 6:
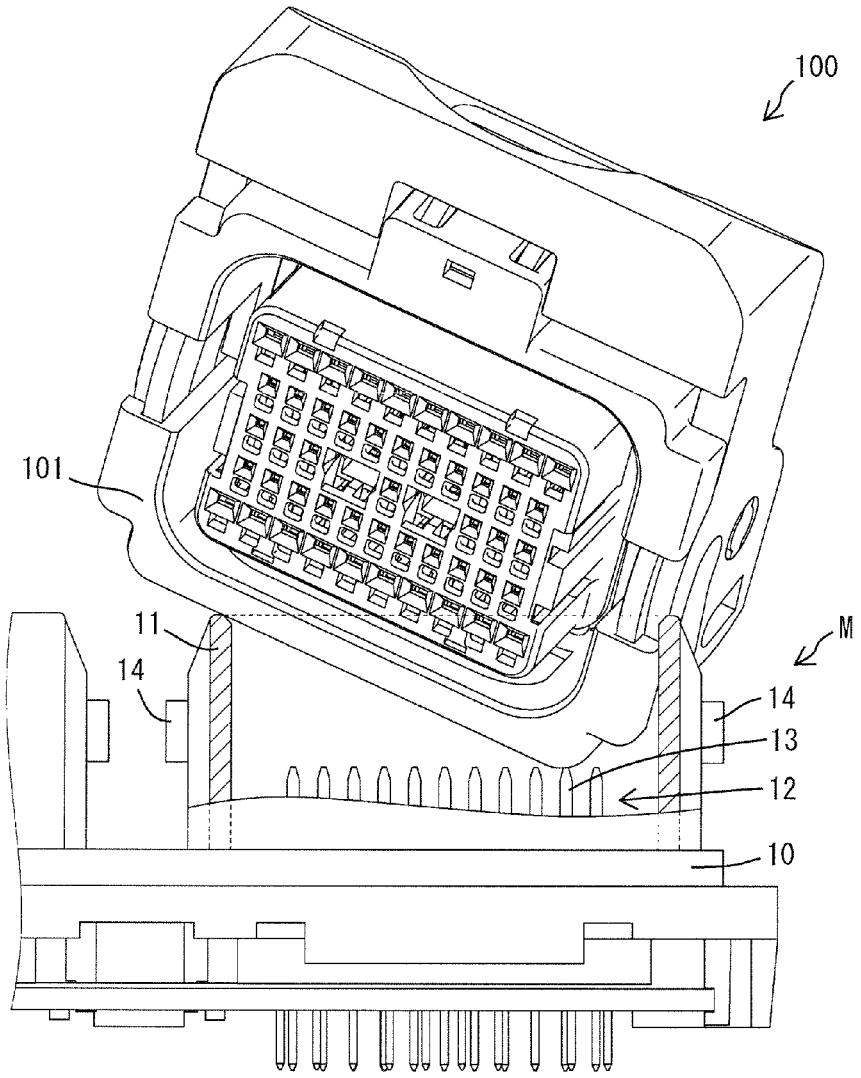
FIG. 6 is a side view partly in section showing a state where a female connector formed with no bulge is inserted in an improper oblique posture into the receptacle.

As shown in FIG. 5, an attempt could be made to insert the female connector F into the receptacle 11 in an improper oblique posture IOP. However, the outer peripheral edges at the front of two angularly aligned walls of the tubular fitting 35 (e.g. the lower wall 39 and a side wall 38) contact the opening edge at the front of the receptacle 11. At this time, if no bulge was formed on the outer periphery of a tubular fitting 101 as in a female connector 100 shown in FIG. 6, the female connector 101 would be inserted relatively deeply into the receptacle 11. However, in this embodiment, the bulges 51, 52 and 53 bulge out from the outer peripheral edge at the front end of the tubular fitting 35. Thus, the receptacle 11 is inserted less into the receptacle 11 than in FIG. 6 as shown in FIG. 5. Accordingly, the female connector F does not contact the tabs 13 in the receptacle 11. In addition, the bulges 51, 52 and 53 are formed on all four walls 37, 38 and 39, entrance in an improper posture IOP is prevented reliably regardless of the orientation of the female connector F with respect to the receptacle 11.

In this embodiment, it is not necessary to change the shape of the male connector M to prevent the contact of the female connector F with the tabs 13. Thus, the shape of the male connector M is not complicated. If a rib for preventing contact with the tabs 13 projects in a receptacle, a recess needs to be formed in the front surface of a female connector to avoid interference with the rib. However, the rib is not formed in the receptacle in this embodiment, it is not necessary to form a recess in the front surface of the female connector F. In addition, the bulges 51, 52 and 53 bulge out from the opening edge at the front of the tubular fitting portion 35 are formed only on the four walls 37, 38 and 39 of the tubular fitting 35 to prevent the female connector F from contacting the tabs 13. Thus, the shape of the female connector F is relatively simple and a change in the shape of the female connector F in forming the bulges 51, 52 and 53 is suppressed to a minimum level.

The mounting hole 29 is formed on the outer surface of the terminal accommodating portion 21 to receive the retainer 30 that retains the female terminal fittings 24. The operation hole 43 in the tubular fitting 35 corresponds to the mounting hole 29 and is behind the first bulge 51. The area of the outer surface of the tubular fitting portion 35 behind and adjacent to the operation hole 43 defines the finger placing surface 44 that will face a finger pushing the retainer 30 facing the operation hole 43. The finger placing surface 44 is a recess in the outer surface of the lower wall 39. Accordingly, an elevation difference between the finger placing surface 44 and the lower surface 28 of the terminal accommodating portion 21 is reduced and the retainer 30 can be pushed easily.

The clearance between the lower surface 28 of the terminal accommodating portion 21, which is formed with the mounting hole 29, and the inner surface of the lower wall 39 opposed to the mounting hole 29 defines the operation space 42 that can receive the jig 60 from the front for moving the retainer 30 away from the mounting hole 29. In this embodiment, the lower wall 39 has the cutout 54 formed by recessing the inner surface of the first bulge 51 facing the operation space 42. Accordingly, the operation space 42 becomes larger in the vertical direction (i.e. direction parallel to the moving directions of the retainer 30) to improve operability of the jig 60. Further, since the first bulge 51 formed with the cutout 54 bulges out on the tubular fitting 35, the lower wall 39 is not thinned excessively even though the cutout 54 is recessed in the inner surface of the first bulge 51.

The invention is not limited to the above described embodiment. For example, the following embodiments also are included in the scope of the invention.

The bulges are formed on all four walls in the above embodiment, but may be formed on three or fewer walls.

The bulge is formed on the wall corresponding to the mounting hole for the retainer in the above embodiment. However, the bulge may be formed only on the wall not corresponding to the mounting hole for the retainer.

The finger placing surface is formed in the area extending from the rear end of the operation hole to the rear end of the tubular fitting in the above embodiment. However, the formation area of the finger placing surface may extend from the rear end of the operation hole to a position before the rear end of the tubular fitting.

The finger placing surface is a recess in the outer surface of the tubular fitting in the above embodiment, but the finger placing surface need not be recessed.

The wall facing the operation space is formed with the cutout by recessing the inner surface of that wall in the above embodiment, but a cutout need not be formed.

The area formed with the bulge on the wall facing the operation space is thinner than the area not formed with the bulge in the above embodiment. However, the thickness of the area formed with the bulge may be equal to or larger than the area without the bulge.

What is claimed is:

1. A connector connectable with a mating connector, comprising:

a housing having a terminal accommodating portion for accommodating at least one terminal fitting, the terminal accommodating portion being formed with a mounting hole that is open on an outer surface of the terminal accommodating portion;

a retainer mounted in the mount hole for retaining the terminal fitting;

a tubular fitting having a rear end connected to the terminal accommodating portion and a front end opposite the rear end, the tubular fitting substantially surrounding the terminal accommodating portion;

a forwardly open clearance between the terminal accommodating portion and the tubular fitting for receiving a receptacle of the mating connector; and at least one bulge bulging laterally out at the front end of the tubular fitting and being engageable with the receptacle of the mating connector to avoid connection of the connector with the mating connector in an improper oblique posture.

2. The connector of claim 1, wherein the tubular fitting has a plurality of walls, the at least one bulge comprising plural bulges formed respectively on each of the walls of the tubular fitting.

3. The connector of claim 1, wherein an operation hole is formed through the tubular fitting at a position aligned with the mounting hole and behind the bulge.

4. The connector of claim 3, wherein a formation range in the width direction of the bulge has a width substantially equal to a width of the operation hole.

5. The connector of claim 3, further comprising a finger placing surface on an area of an outer surface of the tubular fitting located behind and adjacent to the operation hole that will face fingers operating the retainer facing the operation hole.

6. The connector of claim 5, wherein the finger placing surface is recessed on the outer surface of the tubular fitting.

7. The connector of claim 1, further comprising an operation space in a clearance between the terminal accommodating portion and a wall of the tubular fitting facing the mounting hole, the operation space accommodating a jig inserted from the front for moving the retainer away from the mounting hole.

8. The connector of claim 7, wherein the bulge is formed on the wall facing the operation space.

9. The connector of claim 8, wherein the wall facing the operation space is formed with a cutout by recessing an inner surface of the bulge.

10. A connector connectable with a mating connector, comprising:

a housing having a terminal accommodating portion for accommodating at least one terminal fitting;

a tubular fitting having a rear end connected to the terminal accommodating portion and a front end opposite the rear end, the tubular fitting substantially surrounding the terminal accommodating portion;

a forwardly open clearance between the terminal accommodating portion and the tubular fitting for receiving a receptacle of the mating connector;

at least one bulge bulging laterally out at the front end of the tubular fitting and being engageable with the receptacle of the mating connector to avoid connection of the connector with the mating connector in an improper oblique posture;

a movable member movably provided in or on the tubular fitting to be displaced between an initial position and a connection position for connecting and separating the connector with the mating connector, wherein the movable member is held at the connection position by a lock that projects from an outer surface of the bulge.

* * * * *